US012376669B1

(12) United States Patent
Tabeek

(10) Patent No.: US 12,376,669 B1
(45) Date of Patent: Aug. 5, 2025

(54) CARRYING STRAP SYSTEM

(71) Applicant: Michael Tabeek, Las Vegas, NV (US)

(72) Inventor: Michael Tabeek, Las Vegas, NV (US)

( * ) Notice: Subject to any disclaimer, the term of this patent is extended or adjusted under 35 U.S.C. 154(b) by 134 days.

(21) Appl. No.: 18/517,955

(22) Filed: Nov. 22, 2023

Related U.S. Application Data

(60) Provisional application No. 63/475,659, filed on Dec. 1, 2022.

(51) Int. Cl.
*A45F 3/14* (2006.01)
*A45F 3/00* (2006.01)

(52) U.S. Cl.
CPC ..... *A45F 3/14* (2013.01); *A45F 2003/003* (2013.01); *A45F 2003/142* (2013.01)

(58) Field of Classification Search
CPC ..... A45F 3/14; A45F 2003/003; A45F 2003/142; A45F 3/12; A45F 3/02; A45F 3/04; A41F 15/007; A41F 15/02; A45C 13/30
USPC ..... 224/250, 257, 260, 264
See application file for complete search history.

(56) References Cited

U.S. PATENT DOCUMENTS 1,631,694 A * 6/1927 Rick ..... A45F 3/12 224/264
3,377,007 A * 4/1968 Gayler, Jr. ..... B63B 32/87 294/157
4,114,838 A * 9/1978 Knauf ..... A45F 5/00 294/157
4,911,347 A * 3/1990 Wilhite ..... A45F 3/14 224/264
5,129,564 A * 7/1992 Danezin ..... A63B 55/408 150/108
5,501,505 A 3/1996 Jablonski
5,893,503 A * 4/1999 Jean ..... A45F 3/14 224/264
6,006,974 A 12/1999 Varney et al.
6,764,132 B1 7/2004 Gaertner
7,125,071 B2 10/2006 Aiudi
7,619,884 B1 * 11/2009 Gray ..... G06F 1/26 361/679.41
10,039,368 B2 * 8/2018 Christman ..... A45F 3/14
2007/0175940 A1 8/2007 Sacks
2008/0078789 A1 4/2008 Fiola

* cited by examiner

*Primary Examiner* — Adam J Waggenspack

(74) *Attorney, Agent, or Firm* — Invention To Patent Services; Alex Hobson

(57) ABSTRACT

A durable and flexible carrying strap system is configured to be used to carry portable outdoor furniture efficiently and conveniently. The carrying strap system includes adjustable loops at each endpoint for accommodating the portable outdoor furniture. The carrying strap system is used to carry portable outdoor furniture and other items such as an umbrella simultaneously. The carrying strap system may also include a charging module for charging a portable electronic device while the carrying strap system is in use.

20 Claims, 11 Drawing Sheets

CARRYING STRAP SYSTEM

CROSS REFERENCE TO RELATED APPLICATIONS

This application claims the benefit of priority to U.S. provisional patent application No. 63/475,659, filed on Dec. 1, 2022; the entirety of which is hereby incorporated by reference herein.

FIELD OF THE INVENTION

The present invention relates to carrying systems for transporting an article or item on the body. More particularly, the present invention relates to a flexible carrying strap system for carrying an article such as foldable chairs, umbrellas, and personal items, and the like as a single unit as well as providing charging to portable electronic devices.

BACKGROUND OF THE INVENTION

Portable outdoor furniture is extremely popular and commonly found at virtually every outdoor event. Portable outdoor furniture includes collapsible chairs, foldable chairs, umbrellas and the like. When visiting a sporting event, the beach, on a fishing trip, going camping, hiking, or otherwise traveling by foot to a remote location, there are a number of items a person often needs to carry with them. For example, a person often brings a collapsible folding chair, one or more fishing poles, an umbrella, coolers, towels, and the like. Many of these items are awkwardly shaped and difficult to carry. Thus, the beach goer, hunter, hiker, camper or sporting event attendee may be required to make a number of separate trips, potentially over rough terrain, in order to carry all of the gear to the destination. Additionally, to many consumers in these environments, folding sports chairs are the best option for seating as they are comfortable and can be used practically anywhere. And that is why you will find Soccer Moms and Baseball Dads comfortably relaxing in these portable outdoor chairs at sports fields everywhere.

Millions of Soccer Moms and Baseball Dads in the U.S. are on the sidelines rooting for their kids nearly every weekend. Not just for soccer and baseball, but for many other sporting activities, too. These are all common activities, and for American families they are as traditional as, well-apple pie. For parents, standing on the sidelines throughout the entire game, though, it can feel as physically strenuous as actually playing the game. These amateur playing fields do not have much, if any, seating available. Even those with stands do not have enough space and furniture to accommodate all the attendees. Even worse, bleachers are uncomfortable, are not very stable, and can even be dangerous to climb in search of seating. That is why many moms, dads and other spectators bring their own folding sports chairs to the games. They can be placed practically anywhere, providing close sideline seats. They are rather comfortable, too, providing support and cushion in proper positions, complete with arm rests and cup-holders.

Lugging those foldable chairs to and from the field, however, is not nearly as comfortable. Some people swing the bag holding their foldable sports chairs upon their shoulders, but that can produce aches, pains, bruises and scratches and even clothing tears. Often these storage bags are torn or even missing so people have to carry the chairs with both arms, which make it take longer to arrive at the desired location.

Some portable outdoor and folding furniture items generally come along with their own carrying cases. While this might add some posh and presumed value to those items, these carrying cases easily wind up providing the exact opposite. There is nothing posh about carrying cases that are easily torn, for example. Tears are difficult to avoid, however, when the sharp edges and corners of foldable furnishings are inserted inside these fabric sleeves. All the posh is gone, and gets replaced by an eyesore. This quick-and-easy damage also leads to a need to replace these carrying cases. That adds additional expense, which damages the value of the folding furniture to consumers. If not replaced, though, consumers are left with greater difficulty in carrying these unsecured items, which can easily unfold during the transportation.

As stated, many of these collapsible chairs are carried by storage bags of some kind and many examples of such devices can be found in the prior art. The problem, however, is that due to the irregular shape and configuration of these collapsible chairs in their folded states, loading and unloading them into and from their respective carriers can be very difficult and even frustrating. The same situation applies to folding tents and other equipment as well.

In fact, foldable chairs and umbrellas are in use at practically every youth sporting event, every picnic, on every hiking trail, at every campsite, and even shorelines frequented by fishermen. As mentioned, the comfort and relaxation of those common furniture items disappears, though, when you try to get them to those locations. As referenced, their standard carrying bags are difficult to use, are easily damaged, frequently need replacement, and even cause damage to the foldable items they are supposed to host. Those carrying bags are not comfortable to carry, either. If you also need to bring other items with you, then be prepared for multiple trips to your vehicle because those carrying bags cannot accommodate anything else. To be blunt, those common carrying bags are frustrating, time consuming and difficult to use. Everyone partaking in such recreation faces the same inconveniences when it comes to getting those portable furnishings where they want them.

Traditional bags, packs, and carrying cases may only be able to accommodate a single item, such as the collapsible folding chair, or a small number of objects. In addition, most carrying cases are not able to carry disparate objects, such as fishing poles, sand spikes, beach umbrellas or other elongated objects. Thus, there are a number of drawbacks with traditional carrying cases. For example, tears are difficult to avoid when the sharp edges and corners of foldable furnishings are inserted inside these fabric sleeves. This quick-and-easy damage also leads to a need to replace these carrying cases. That adds additional expense, which damages the value of the folding furniture to consumers. If not replaced, though, consumers are left with greater difficulty in carrying these unsecured items, which can easily unfold during the transport.

There are various examples of carrying cases explained below that are available for accommodating collapsible chairs. US Publication 20140144963 assigned to Initiate Launch LLC describes a carrying bags for transporting products, equipment, goods, or consumables. In one form, the first reservoir provides for the containment of a chair. The chair can be in the form of a camp chair, a travel chair, or a foldable chair, and is collapsible between an expanded configuration and collapsed configuration. Although, the carrying bags used for transporting chairs only. However, the folding sports chair needs to be tightly closed in order to fit within the small mouth of its carrying bag. The bag needs to be fully extended and open, too, which requires the chair to be lifted in order to be smoothly inserted. These circumstances can frequently cause frustration, aggravation, and delay. Hoping to avoid multiple trips to and from their cars to set up their places in the sideline, some peoples attempt to slide the umbrella and alike items into the same nylon bag that is hosting their foldable chair. This can easily damage the bags, though, as well as the chair and the umbrella. It is already difficult to maneuver the folded chair into its tight carrying bag and then try to carry it over to a desired location. It becomes even harder, though, when you need to carry other items and can be more damaging, too.

There are many portable furniture carrying devices available that includes straps and alike structures. Another U.S. Pat. No. 3,960,302 assigned to Albert H. Mazzoni discloses a ski carrying apparatus including a nylon strap which can be either hand held or placed over the shoulder of the carrier. The ends of the strap are loosely tied to the fore and aft portions of the skis. Spaced strips of mutually engageable fastening material are attached to each end of the strap and engaged after the knots are tied to inhibit untying of the loosely tied ends of the strap. Although the ski carrying apparatus need to be fasten to secure a bag or other objects to a user to facilitate carrying the bag. However, these fasteners and sleeves are also difficult to use.

Another U.S. Pat. No. 5,437,401 assigned to Richard Seltzer discloses a personal harness for carrying at least one article. The harness has a shoulder strap with a pair of carrying ends. The harness also includes a pair of hitch means for holding at least the one article. This pair of hitch means is separately attached to the shoulder strap near the pair of carrying ends. Although, the harness needs to tightly compress any hosted items and hold the items at a difficult position.

Although, the prior art aforementioned has certain disadvantages including damages to the cases and available strap carriers requires tightening of the collapsible chairs and alike within the straps causing contact damages to the collapsible chairs, and unable to carry multiple items at a single time. Therefore, the present invention is designed to address the peculiar challenges in the prior art, the present invention discloses a novel carrying strap system that makes usage of the carrying strap system easier, simpler and faster to carry and set up portable items in any area of use as well as to charge personal electronics with it, too.

It is apparent now that numerous methods and systems are developed in the prior art that are adequate for various purposes. Furthermore, even though these inventions may be suitable for the specific purposes to which they address, accordingly, they would not be suitable for the purposes of the present invention as heretofore described. Thus, there is a need to provide an easy to use and flexible carrying strap system to carry multiple items at once, unlike standard carrying bags that can only carry a single, specific corresponding item.

SUMMARY OF THE INVENTION

In accordance with the present invention, the disadvantages and limitations of the prior art are substantially avoided by providing a carrying strap system for carrying of portable outdoor furniture, such as but not limited to foldable sports chairs, foldable deck chairs, foldable canopy chairs, and other portable outdoor furniture.

The carrying strap system includes a base strap for placing the carrying strap system on a shoulder of a user. The base strap includes a first end, and a second end opposite to the first end. The base strap further includes a centerpoint at middle of the base strap. The base strap includes a padded sleeve positioned at the centerpoint of the base strap.

The padded sleeve includes an upper surface, a lower surface and a pair of slits placed at equal distance from the centerpoint. Further, the pair of slits includes a first slit and a second slit, the base strap passes through the lower surface of the first slit to the upper surface of the first slit and received by the upper surface of the second slit to the lower surface of the second slit. Further, a portion or a segment of the base strap may be pulled up by a user to hold the carrying strap system by hands.

Further, the padded sleeve includes a pair of solar panels positioned at equal distance from the centerpoint on the upper surface of the padded sleeve. Further, the padded sleeve includes a pocket positioned on a sidewall of the padded sleeve. Further, the pocket includes an electronic battery and transformer connected through wires with the pair of solar panels to charge the battery. The battery stores the solar energy. The pocket further includes a user interface connected with the electronic battery through wires to charge one or more electronic items and capable of receiving number of charging cables for charging a number of electronic devices. More particularly, the user interface includes a plurality of charging points or ports positioned on the top surface of the pocket capable of receiving a number of charging cables to charge the portable electronic devices.

Further, the carrying strap system includes a first strap sleeve that receives the base strap from the first end of the base strap. Further, the first strap sleeve includes a first strap passing through the first strap sleeve to form a first loop capable of accommodating a portion of an article, which is adjustable using a first buckle at ends of the first strap.

In preferred embodiment of the present invention, the first strap is stitched or sewn to the first end of the base strap. The second strap is stitched or sewn to the second end of the base strap. The first strap is perpendicularly attached to the first end of the base strap and further the second strap is perpendicularly attached to the second end of the base strap.

Further, the carrying strap system includes a second strap sleeve that receives the base strap from the second end of the base strap. Further, the second strap sleeve includes a second strap passing through the second strap sleeve to form a second loop capable of accommodating a portion of an article, which is adjustable through a second buckle at ends of the second strap. Further, the first loop and the second loop support the article to be carried for transporting purposes from one place to another. The first buckle and the second buckle are selected from slide-release buckles, cam buckles, lashing clips, snaps, buttons, hook-and-loop material, ties or ratchets.

Further, the first buckle includes a first male member secured at one end and a first female member at another end of the first strap. The first male member and the first female member fasten together to form a first loop. Further, the second buckle includes a second male member at one end and a second female member at another end of the second strap. The second male member and the second female member fasten together to form a second loop. The first loop and the second loop support one or more articles for transporting purposes. More specifically, the first loop and the second loop enwrap the articles within the loops to transport the portable outdoor furniture. The portable outdoor furniture may be any foldable lounge chairs, foldable deck chairs, foldable canopy chairs, foldable sports chairs, beach umbrellas, traditional umbrellas, and other portable outdoor furniture and ice chests, toolboxes, ladders, skis, pipes, lumber, skateboards, conduit, and many other items.

In one embodiment of the present invention, the padded sleeve includes a hollow interior cavity below the upper surface and above the lower surface of the padded sleeve for accommodating a number of items. The hollow interior cavity is capable of being closed with a securing member. The securing member may be a zipper, hook-and-loop material, buttons or ties for closing or sealing the hollow interior cavity. The number of items may include credit cards, debit cards, wallets, Smartphones, currencies, house keys and the like. In one alternative embodiment of the present invention, the base strap includes an adjustment buckle near the second end for adjusting length of the base strap.

In one embodiment of the present invention, the base strap, first strap and the second strap are made of nylon and polyester in a woven blend. In one alternative embodiment of the present invention, the base strap, the first strap and the second strap may be made of polyester, polyethylene terephthalate (PET), polypropylene, and any combination thereof. The base strap is forty-eight inches in length by one inch in width (48"×1"). The lower surface of the padded sleeve features a textured surface for grip enhancement upon a shoulder of a user. The textured surface is formed by nylon fabric with a thin coating of rubber. The padded sleeve is eight inches (8") in length by to two-inches (2") in width by three-quarters of an inch (¾") in depth.

In one exemplary embodiment of the present invention, the padded sleeve, the first strap sleeve and second strap sleeve include logo tab assemblies for securing logos and the like. The logo tab assembly includes a plastic indentation for securing a logo and the like.

A primary objective of the present invention is to provide a novel carrying strap system that can be used with many different portable, foldable items, as well as other elongated rod-shaped items.

An objective of the primary objective of the present invention is to provide a flexible and efficient carrying strap system used to carry multiple items at once, unlike standard carrying bags that can only carry a single, specific corresponding item.

Another objective of the present invention is to provide the carrying strap system for transporting multiple items thereby hosting multiple items reduces the time ordinarily required for a user to bring items to or from a place of use.

Yet another objective of the present invention is to provide the carrying strap system including loops for hosting other items, such as but not limited to umbrellas, in addition to its corresponding folding sports chair.

An objective of the primary objective of the present invention is to provide carrying strap system that includes a pocket within the padded sleeve allowing the user to also transport commonly needed personal items such as a Smartphone, phone, wallet, house key, currency, and alike.

Another objective of the present invention is to provide the carrying strap system including length adjustable base strap configured for placing the carrying strap system upon the shoulder of its users, thereby allowing the users to keep both hands free during such transport to carry other items at the same time.

Yet another objective of the present invention is to provide the carrying strap system allows the users to carry multiple items to be transported simultaneously, thereby allowing the users to enter and exit sites of use much faster and eliminates the need for users to make multiple trips to and from a site of use of the multiple items.

An objective of the present invention is to provide the carrying strap system allowing a user to charge portable electronic devices, such as smartphones and tablets and alike.

Another objective of the present invention is to provide the carrying strap system including strap sleeves preventing the strap connection points from failing when a user is transporting a load.

Yet another objective of the present invention is to provide a base strap, first strap and second strap including logo tab assemblies which host logo tabs allowing the carrying strap system to be personalized.

An objective of the primary objective of the present invention is to provide a carrying strap system made of exceptionally durable, waterproof, and resistant to damages from exposure to ultraviolet (UV) lights.

Another objective of the present invention is to provide a flexible carrying strap system that can appeal to very large consumer markets who frequently engage in activities and environments in which it can be used, ranging from sporting event attendees to beachgoers to outdoor event attendees to picnickers to many other applicable consumer groups.

Yet another objective of the present invention is to provide a carrying strap system that include loops for hosting other items, such as but not limited to umbrellas, in addition to a folding sports chair.

An objective of the primary objective of the present invention is to provide a carrying strap system that includes a pocket within the padded sleeve allowing the user to also transport commonly needed items such as a smartphone, wallet, house key, currency, etc.

Yet another objective of the present invention is to provide a comfortable, ease-to-use, and convenient way to carry multiple items simultaneously.

An objective of the primary objective of the present invention is to provide a novel carrying strap system that makes usage of the carrying strap system easy, simple and fast to set up portable items in any area of use as well as charge personal electronics with it, too.

In one alternative embodiment of the present invention is to provide a carrying strap system for carrying an article. The carrying strap system includes a base strap for placing the carrying strap system on a shoulder of a user. The base strap includes a first end, and a second end opposite the first end. The base strap further includes a centerpoint at middle of the base strap. The base strap includes a padded sleeve positioned at the centerpoint of the base strap. The padded sleeve includes an upper surface and a lower surface and further the padded sleeve is positioned at the centerpoint of the base strap. The padded sleeve includes a pair of slits placed at equal distance from the centerpoint. The base strap passes through the lower surface of a first slit to the upper surface of the first slit and received by the upper surface of a second slit to the lower surface of the second slit. Further, the padded sleeve includes a hollow interior cavity below the upper surface and above the lower surface of the padded sleeve. Further, the hollow interior cavity is capable of being closed with a securing member. The securing member may be a zipper, buttons, ties and like members.

Further, the carrying strap system includes a first strap sleeve that receives the base strap from the first end. The first strap sleeve includes a first strap passing through the first strap sleeve to form a first loop and further the first strap is adjustable through a first buckle at ends of the first strap. Further, the carrying strap system includes a second strap sleeve that receives the base strap from the second end. The second strap sleeve includes a second strap passing through the second strap sleeve to form a second loop and further the second strap is adjustable through a second buckle at ends of the second strap. Further, the first loop and the second loop support the article to be carried for transporting the article from one place to other.

Further, the padded sleeve further includes a pair of solar panels positioned at equal distance from the centerpoint on the upper surface of the padded sleeve. Further, the padded sleeve includes a pocket positioned below the upper surface of the padded sleeve. Further, the pocket includes an electronic battery and transformer connected with the wires to the pair of solar panels and a plurality of charging points connected with the electronic battery through wires to charge one or more electronic items.

In another alternative embodiment of the present invention is to provide a carrying strap system for carrying one or more articles from one place to another. The carrying strap system includes a base strap that includes a first end and a second end opposite to the first end, and a centerpoint, further wherein the base strap includes an adjustment buckle near the second end for adjusting length of the base strap. Further, the carrying strap system includes a padded sleeve positioned at the centerpoint of the base strap. The padded sleeve includes an upper surface and a lower surface. Further, the padded sleeve includes a pair of slits on the upper surface and further placed at equal distance from the centerpoint. The base strap passes through the lower surface of a first slit to the upper surface of the first slit and received by the upper surface of a second slit to the lower surface of the second slit.

Further, the padded sleeve includes a hollow interior cavity below the upper surface and above the lower surface of the padded sleeve for accommodating a number of items. The hollow interior cavity is capable of being closed with a securing member. The securing member is either a zipper, hook-and-loop material, buttons or ties. The number of items may include credit cards, debit cards, Smartphones, currencies, house keys and alike.

Further, the carrying strap system includes a first strap sleeve that receives the base strap from the first end. The first strap sleeve includes a first strap passing through the first strap sleeve to form a first loop for enwrapping a portion of an article to be carried. Further, the first strap is adjustable through a first buckle at ends of the first strap. Further, the carrying strap system includes a second strap sleeve that receives the base strap from the second end. The second strap sleeve includes a second strap passing through the second strap sleeve to form a second loop for enwrapping a portion of the article to be carried. Further, the second strap is adjustable through a second buckle at ends of the second strap.

Other objectives and aspects of the invention will become apparent from the following detailed description, taken in conjunction with the accompanying drawings, which illustrate, by way for example, the features in accordance with embodiments of the invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Although, the invention is described above in terms of various exemplary embodiments and implementations, it should be understood that the various features, aspects, and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

The presence of broadening words and phrases such as "one or more," "at least," "but not limited to" or other like phrases in some instances shall not be read to mean that the narrower case is intended or required in instances where such broadening phrases may be absent.

BRIEF DESCRIPTION OF SEVERAL VIEWS OF THE DRAWINGS

The accompanying drawings illustrate various embodiments of systems, methods, and embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another and vice versa. Furthermore, elements may not be drawn to scale. Non-limiting and non-exhaustive descriptions are described with reference to the following drawings. The components in the figures are not necessarily to scale, emphasis instead being placed upon illustrating principles. Furthermore, the drawings may contain text or captions that may explain certain embodiments of the present invention. This text is included for illustrative, non-limiting, explanatory purposes of certain embodiments detailed in the present invention. In the drawings.

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION OF THE ILLUSTRATED EMBODIMENTS

Figure 1:
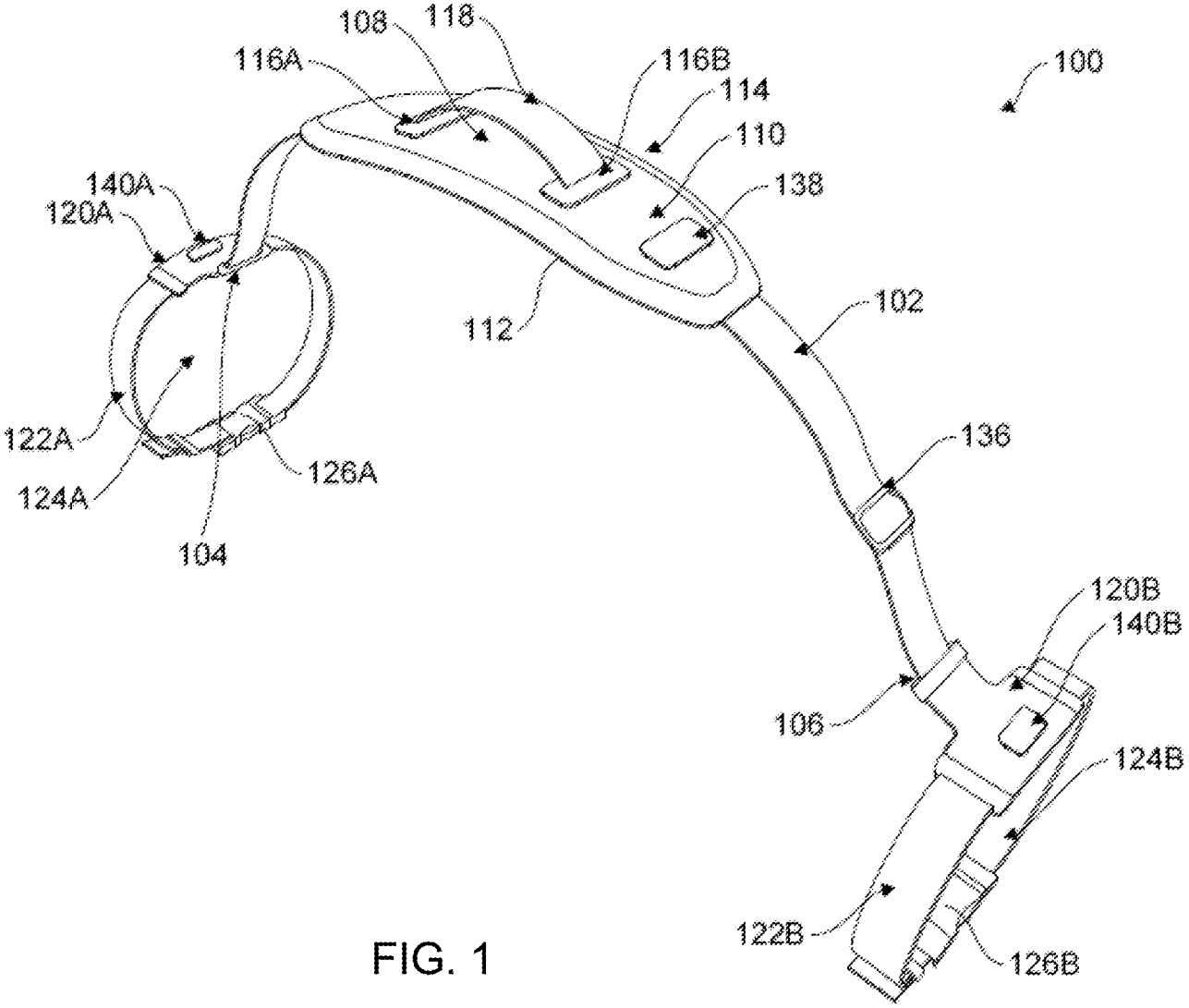
FIG. 1 illustrates a carrying strap system in accordance with the present invention.

The present specification is directed towards multiple embodiments. The following disclosure is provided in order to enable a person having ordinary skill in the art to practice the invention. Language used in this specification should not be interpreted as a general disavowal of any one specific embodiment or used to limit the claims beyond the meaning of the terms used therein. The general principles defined herein may be applied to other embodiments and applications without departing from the spirit and scope of the invention. Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention.

In the description and claims of the application, each of the words "units" represents the dimension in any units such as centimeters, meters, inches, foots, millimeters, micrometer and the like and forms thereof, are not necessarily limited to members in a list with which the words may be associated.

In the description and claims of the application, each of the words "comprise", "include", "have", "contain", and forms thereof, are not necessarily limited to members in a list with which the words may be associated. Thus, they are intended to be equivalent in meaning and be open-ended in that an item or items following any one of these words is not meant to be an exhaustive listing of such item or items, or meant to be limited to only the listed item or items. It should be noted herein that any feature or component described in association with a specific embodiment may be used and implemented with any other embodiment unless clearly indicated otherwise.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items from the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present invention contains headers. It should be understood that these headers are used as references and are not to be construed as limiting upon the subjected matter disclosed under the header.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

The presence of broadening words and phrases such as "one or more," "at least," "but not limited to" or other like phrases in some instances shall not be read to mean that the narrower case is intended or required in instances where such broadening phrases may be absent.

It must also be noted that as used herein and in the appended claims, the singular forms "a," "an," and "the" include plural references unless the context dictates otherwise. Although any systems and methods similar or equivalent to those described herein can be used in the practice or testing of embodiments of the present disclosure, the preferred, systems and methods are now described.

The present invention discloses a novel carrying strap system that makes usage of the carrying strap system easier, simpler and faster than the prior art to set up portable items in any area of use as well as to charge personal electronics with it, too. A flexible and efficient carrying strap system used to carry multiple items at once, unlike standard carrying bags that can only carry a single, specific corresponding item. Portable outdoor furniture, includes but is not limited to foldable lounge chairs, foldable deck chairs, foldable canopy chairs, foldable sports chairs and other portable outdoor furniture. Disclosed is a novel carrying strap system that can be used with many different portable, foldable items, as well as other elongated rod-shaped items. The carrying strap system is also used for transporting other items secured within the adjustable loops, such as but not limited to umbrellas, in addition to its corresponding folding sports chair. A carrying strap system including length adjustable strap configured for efficient usage of the system.

Referring now to FIGS. 1 to 11, a carrying strap system 100 is configured for carrying one or more items from one place to another by a user, such as during a sporting event attendance, beach visits and the like. The carrying strap system 100 is well suited for carrying of portable outdoor furniture, such as but not limited to foldable lounge chairs, foldable deck chairs, foldable canopy chairs, foldable sports chairs and other portable outdoor furniture.

Referring now to FIG. 1, the carrying strap system 100 includes a base strap 102 for placing the carrying strap system 100 on a shoulder of a user. The base strap 102 includes a first end 104, a second end 106 opposite to the first end. The base strap 102 further includes a centerpoint 108 for receiving a padded sleeve 114, which is positioned at the centerpoint 108 of the base strap.

The base strap 102 may be made of any material know in art, particularly, the base strap is made of nylon and polyester in a woven blend. The base strap can be made in various lengths and widths, and may be packaged for retail sale in each of said variations. The base strap can be adjustable in length. In a preferred embodiment of the present invention, the base strap measures approximately forty-eight inches in length by one inch in width (48"×1").

The base strap 102 further includes a padded sleeve 114 positioned at the centerpoint 108 of the base strap. The padded sleeve 114 further includes an upper surface 110 and a lower surface 112 and a pair of slits placed at equal distance from the centerpoint 108 of the base strap. Further, the pair of slits includes a first slit 116A and a second slit 11B, the base strap passes through the lower surface 112 of the first slit 116A to the upper surface 110 of the first slit 116A and received by the upper surface of the second slit 116B to the lower surface 112 of the second slit 116B.

Further, a portion or a segment 118 of the base strap 102 can be pulled up by a user to hold the carrying strap system by hands. More specifically, the portion or the segment 118 acts a handle for carrying the carrying strap system 100 by hand from one place to another. A user can carry the carrying strap system using handle, or base strap segment 118 pulled from the first slit and the second slit in the padded sleeve. The bottom surface 112 of the padded sleeve 114 features a textured surface for grip enhancement upon the shoulder of the user. The carrying strap system 100 can be made in variations in which the base strap 102 is padded, and that features a padded segment in its length-center, to provide shoulder comfort while used.

In preferred embodiment of the present invention, the padded sleeve 114 includes a thin layer of internal foam that lines the interior of the padded sleeve to provide a comfortable padding. The padded sleeve can be placed over the shoulder of the user to provide comfort while carrying a load, such as a folding chair.

Further, the base strap 102 includes an adjustment buckle 136 near the second end 106 for adjusting the length of the base strap. The length of the base strap is adjusted using the adjustment buckle depending upon the requirement and comfort of the user.

Further, the carrying strap system 100 includes a first strap sleeve 120A that receives the first end 104 of the base strap 102. Further, the first strap sleeve 120A includes a first strap 122A passing through the first strap sleeve 120A to form a first loop 124A capable of accommodating a portion of an article, which is adjustable using a first buckle 126A at ends of the first strap 122A.

Further, the carrying strap system 100 includes a second strap sleeve 120B that receives the second end 106 of the base strap 102. Further, the second strap sleeve includes a second strap 122B passing through the second strap sleeve 120B to form a second loop 124B capable of accommodating a portion of article, which is adjustable through a second buckle 126B at ends of the second strap 122B.

The first and second strap sleeves 120A, 120B increase the durability of the connection point of all straps as well as prevents the loop-forming straps from twisting and tangling upon themselves. Further, the strap sleeves help to prevent the first and second straps 122A, 122B for twisting and turning, because if the pair of straps twist and turn, it would complicate usage of the pair of straps to form loops and restricts sliding the pair of straps through the respective first and second buckles 126A, 126B.

In an exemplary embodiment of the present invention, the first and second strap sleeves 120A, 120B are made of nylon material, and encapsulate the connection points of the base strap 102 and the pair of straps. The strap sleeves feature three hems sewn to the base strap and the respective first and second straps 122A, 122B. The first and second strap sleeves 120A, 120B increase the durability of the connection point between the base strap 102 and the respective first and second straps. Further, the strap sleeves help to prevent the first and second strap from twisting and turning, because if the first and second straps did twist and turn it would complicate usage of the additional straps to form loops and slide through the buckles.

In a preferred embodiment of the present invention, the first strap 122A is stitched or sewn to the first end 104 of the base strap 102. The second strap 122B is stitched or sewn to the second end 106 of the base strap. The first strap 122A is perpendicularly attached to the first end 104 of the base strap and further the second strap 122B is perpendicularly attached to the second end 106 of the base strap. Further, the first loop 124A and the second loop 124B support the article to be carried for transporting purposes from one place to another.

The first buckle 126A and the second buckle 126B are selected from a group of fasteners such as but not limited to slide-release buckles, cam buckles, lashing clips, snaps, buttons, hook-and-loop material, ties, and ratchets. In a preferred embodiment of the present invention, the first buckle and the second buckle are length-adjustable slide release buckles. The first buckle and the second buckle may be textured to enhance user grip. The slide-release buckles ensure that the straps can be securely enwrapped about the hosted item. Each length-end of the first and second straps 122A, 122B features corresponding segments of a slide-release buckle. The buckles feature a texture to enhance the user's grip when utilizing the product in hot-and-humid weather.

Further, the first buckle 126A includes a first female member 128A secured at one end and a first male member 130A at another end of the first strap 122A. The first female member and the first male member fasten together to form a first loop 124A. Further, the second buckle 126B includes a second female member 128B at one end and a second male member 130B at another end of the second strap. The second female member 128B and the second male member 130B fasten together to form a second loop 124B.

The first loop 124A and the second loop 124B support one or more articles for transporting purposes. More specifically, the first loop and the second loop enwrap the articles within the loops to transport the portable outdoor furniture. The portable outdoor furniture may be any foldable lounge chairs, foldable deck chairs, foldable canopy chairs, foldable sports chairs and other portable outdoor furniture as well as ice chests, toolboxes, ladders, skis, pipes, lumber, skateboards, conduit, umbrellas and other items.

In one embodiment of the present invention, the base strap 102, first strap 122A and the second strap 122B are made of nylon and polyester in a woven blend. In an alternate embodiment of the present invention, the base strap 102, first strap 122A and the second strap 122B are made up of polyester, polyethylene terephthalate (PET), polypropylene, and combination thereof. In a preferred embodiment of the invention, the base strap is forty-eight inches in length by one inch in width (48"×1"). The lower surface of the padded sleeve features a textured surface for grip enhancement upon a shoulder of a user. The textured surface is formed by nylon fabric with a thin coating of rubber. The padded sleeve is eight inches (8") in length by to four-inches (4") in width by three-quarters of an inch (¾") in depth.

The base strap 102, the padded sleeve 114 and the first and second straps 122A, 122B features a rubberized texture for grip enhancement upon a load. In one embodiment of the invention, the bottom surface of base strap, the padded sleeve and the pair of straps feature a texture, which can be produced from stitch, rubber coating or both. In the preferred embodiment of the present invention, the bottom surface side of these base strap, the padded sleeve and the pair of straps feature a light, textured coating of a rubber material such as ethylene propylene diene monomer rubber or a like rubber material. The texture may be produced from various rubber materials such as but not limited to nitrile butadiene rubber (NBR), hydrogenated nitrile (HNBR), carboxylated nitrile (CNBR), acyrlobutadiene styrene (ABS), ethylene propylene diene monomer (EPDM), and neoprene.

The padded sleeve 114 includes a logo tab assembly 138 for accommodating logos and the like. Further, each of the strap sleeves also includes a logo tab assembly, a first logo tab assembly 140A and a second log tab assembly 140B. The logo tab assemblies 138, 140A, 140B includes a plastic indentation or indentations secured within the respective padded sleeve 114 and the first and second strap sleeve 120A, 120B, and interchangeable logo tabs that can be inserted into the indentations. The bottom edge of the logo tabs walls feature outwardly projecting protrusions. These protrusions also known as lips releasably hold the logo tabs in the indentations by friction.

In a preferred embodiment of the present invention, the logo tab assembly 138 is positioned upon the padded sleeve 114. Further the first and second strap sleeves 120A, 120B may each include a respective logo tab assembly 140A, 140B. The logo tab assembly may include rectangular rubber tabs and each tab may have one top surface and four downward projecting walls from the top surface. These downward projecting walls may be short, approximately one-eighth of an inch to one-quarter inch (⅛" to ¼"). There is no bottom so the tabs are hollow and flexible. A projecting lip is located around the bottom edge of the downward projecting walls. Text and images can be printed upon the top surface of the tabs. The rectangular rubber tabs are made from a rubber or plastic material. The rubber material may be nitrile butadiene rubber (NBR), hydrogenated nitrile (HNBR), carboxylated nitrile (CNBR), acyrlobutadiene styrene (ABS), ethylene propylene diene monomer (EPDM), and neoprene. The plastic material may be polypropylene or polyvinyl chloride.

Each logo tab fits into a rectangular indentation. These indentations are found on the padded sleeve 114 and the first and second strap sleeves 120A, 120B. The indentations are like plastic troughs. The tabs snap into and out of these indentations. The projecting lip on the tab walls hold the tabs within the indentations by friction, while still allowing a user to easily change the tabs upon demand. Further, a user may change out one of more of the logo tab assemblies. In a non-limiting example, the user may have logo tabs featuring their favorite baseball team's logo during baseball season, and then change those logo tabs for tabs with their favorite football team's logo during football season.

The logo tab assembly located upon the padded sleeve and the strap sleeve respectively allows the carrying strap system 100 to be personalized. The carrying strap system may or may not feature removable interchange logo tabs, and the logo tabs maybe produced in various colors and may bear various images, patterns, designs, and logos, which may or may not be of registered trademark or copyright status. The carrying strap system may be produced in various colors and may bear various images, patterns, designs, and/or logos, which may or may not be of registered trademark and/or copyright status.

Figure 2:
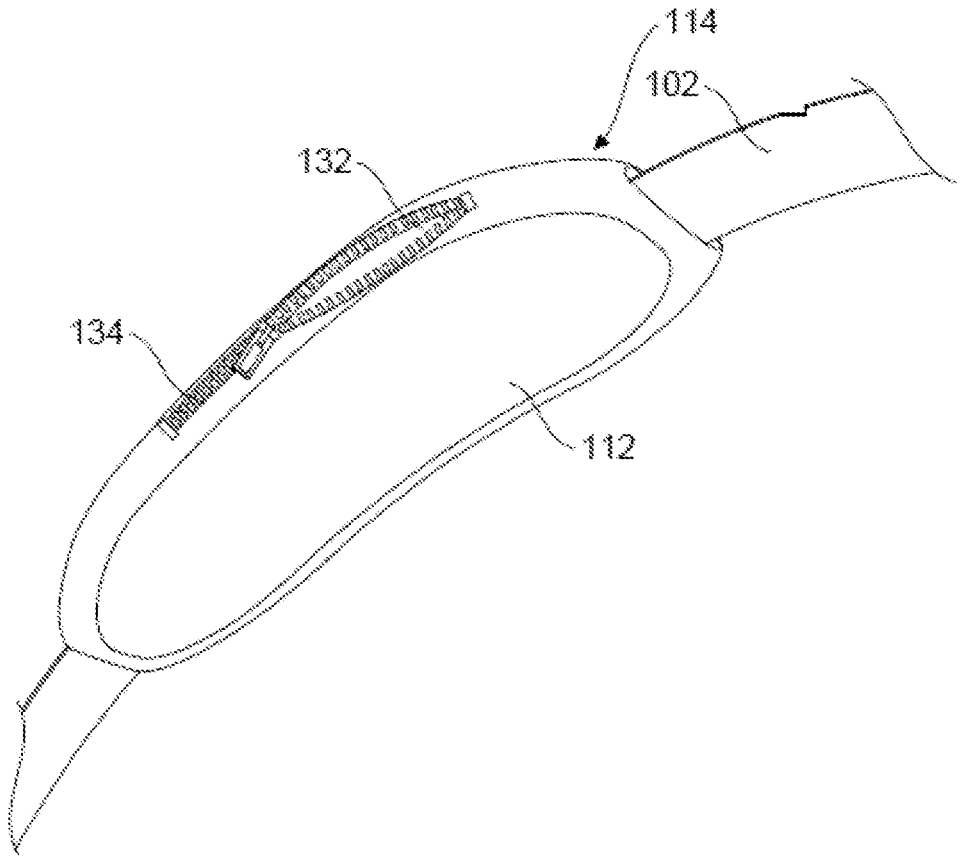
FIG. 2 illustrates a base strap including a padded sleeve with hollow interior cavity in accordance with the present invention.

FIG. 2 illustrates a base strap 102 focusing on padded sleeve 114. The base strap includes a padded sleeve, which is positioned at the centerpoint 108 of the base strap. The padded sleeve includes an upper surface 110, a lower surface 112 and a number of sidewalls. The padded sleeve includes a first slit 116A and a second slit 116B for accommodating a segment 118 of the base strap 102. In one embodiment of the present invention, the portion or the segment of the base strap acts as a handle for carrying the carrying strap system 100 by hand from one place to another in a sports field and the like. A user can carry the carrying strap system using handle formed by the segment 118 of the base strap. The padded sleeve may be a rectangular structure and more specifically the bottom surface 112 of the padded sleeve may feature a textured surface for grip enhancement upon the shoulder of the user.

In another embodiment of the present invention, the padded sleeve 114 includes a hollow interior cavity 132 below the upper surface 110 and above the lower surface 112 of the padded sleeve for accommodating a number of items. The hollow interior cavity is capable of being closed with a securing member 134. The securing member may be a zipper, a hook-and-loop material, buttons or ties for sealing the hollow interior cavity. The number of items may be credit cards, debit cards, wallets, Smartphones, currencies, house keys and alike.

The hollow interior cavity 132 may form a pocket within the padded sleeve 114 that allows the user to also transport commonly needed items such as a smartphone, wallet, house key, currencies, etc. The user can unzip or open the securing member 134 to expose the pocket 132 and place their phone, identification card, and currency within the pocket and then zip or otherwise close the pocket. In alternative embodiment of the present invention, the carrying strap system (100) may feature various pockets that may or may not be removable. The carrying strap system (100) can be made in variations that include storage pockets upon its base strap, and the pockets may be permanently attached and/or may be separate and attachable.

Figure 3:
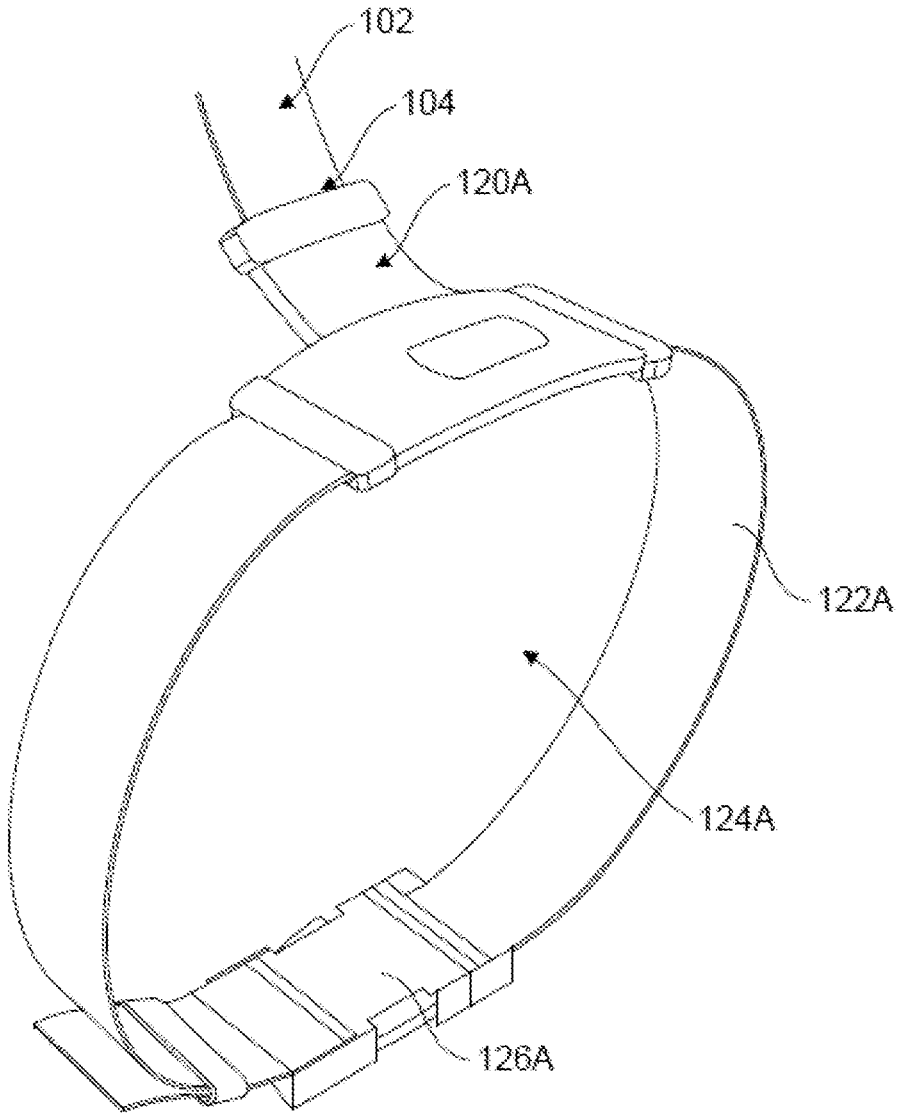
FIG. 3 illustrates a strap which forms an adjustable loop in accordance with the present invention.

FIG. 3 illustrates the first strap 122A and its attachment with the first strap sleeves 120A which further form an adjustable first loop 124 having first buckle 126A. The figure focuses on a first strap 122A and its attachment with the first sleeve 120A of the carrying strap system 100. The carrying strap system 100 includes a first strap sleeve 120A that receives the base strap 102 from the first end 104 of the base strap 102. Further, the first strap sleeve 120A includes a first strap 122A passing through the first strap sleeve to form a first loop 124A capable of accommodating a portion of an article, which is adjustable using a first buckle 126A at the ends of the first strap 122A. Note that this same assembly is configured for the second strap 122B.

In an exemplary embodiment of the present invention, the first strap sleeve 120A is made of nylon material, and encapsulates the connection points of the base strap 102 and the first strap 122A. The strap sleeve features three hems sewn to the base strap and the first strap. In preferred embodiment of the present invention, the first strap is stitched or sewn to the first end 104 of the base strap. The first strap is perpendicularly attached to the first end 104 of the base strap. Further, the first strap sleeve includes a first strap passing through the first strap sleeve \ to form a first loop 124A capable of accommodating a portion of an article, which is adjustable using a first buckle 126A at ends of the first strap. The first strap sleeves increase the durability of the connection points as well as prevent the loop-forming straps from twisting and tangling upon themselves. Further, the first and second strap sleeves help to prevent the first and second straps from twisting and turning, because if the first and second straps twisted or turned, it would complicate usage of the respective first and second straps 122A, 122B to form respective first and second loops 124A, 124B and restrict sliding through the respective first and second buckles 126A, 126B.

Figure 4:
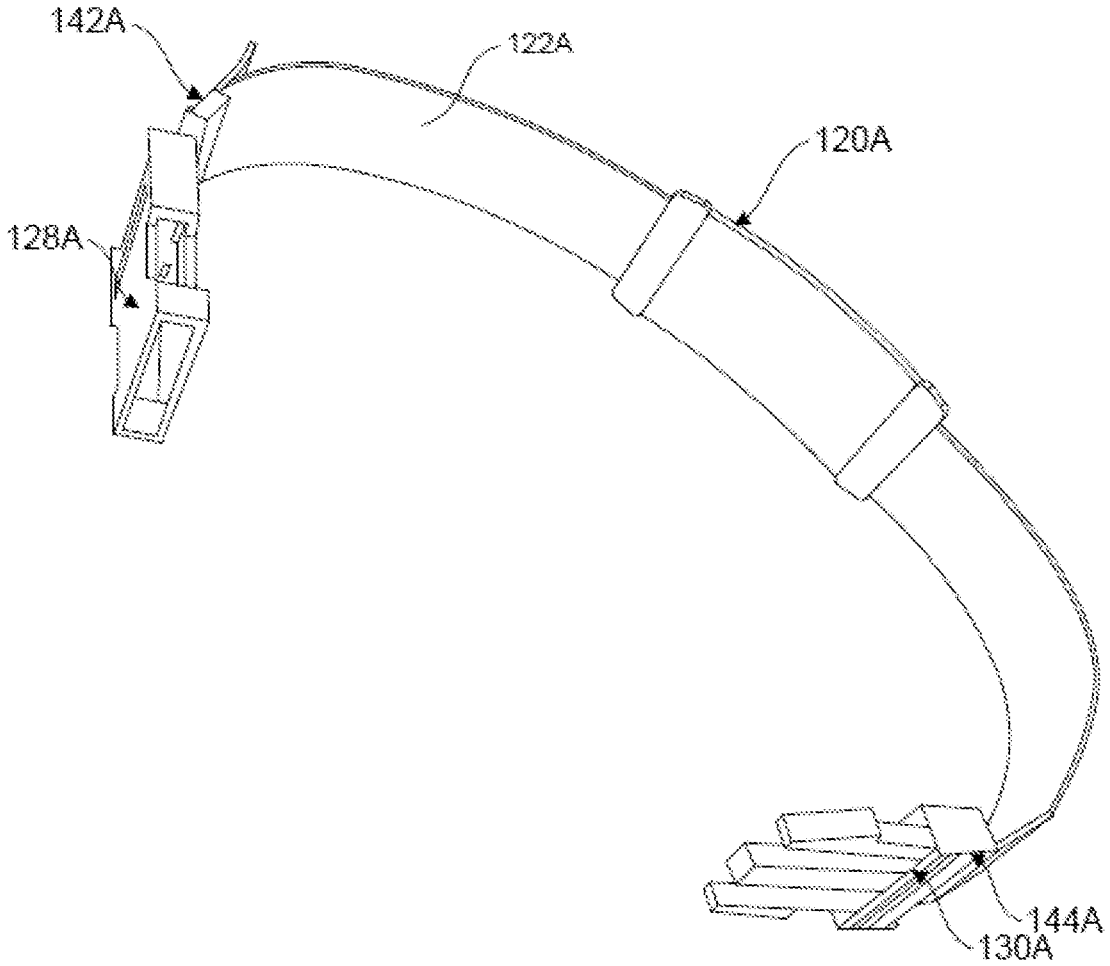
FIG. 4 illustrates a strap in open configuration focusing on a buckle in accordance with the present invention.

FIG. 4 illustrates a first strap 122A in open configuration focusing on a first buckle 126A in accordance with the present invention. The first buckle 126A includes a first female member 128A secured at one end and a first male member 130A at another end of the first strap 122A. The first female member 128A and the first male member 130A fasten together to form a first loop 124A. The first loop 124A and the second loop 124B support one or more articles for transporting purposes. More specifically, the first loop 124A and the second loop 124B enwrap the articles within the loops to transport the portable outdoor furniture. The portable outdoor furniture may be any foldable lounge chairs, foldable deck chairs, foldable canopy chairs, foldable sports chair and other portable outdoor furniture as well as ice chests, toolboxes, ladders, skis, pipes, lumber, skateboards, conduit, umbrellas and other items.

The first buckle 126A and the second buckle 126B are selected from to any of these such as but not limited to slide-release buckles, cam buckles, lashing clips, snaps, buttons, hook-and-loop material, ties, and ratchets. In a preferred embodiment of the present invention, the first buckle and the second buckle are length-adjustable slide release buckles. The first buckle and the second buckle may be textured to enhance user grip. The slide-release buckles and strap texture ensure that the straps can be securely enwrapped about the hosted item. Each length-end of the pair of straps features corresponding segments of a slide-release buckle. The buckles feature a texture to enhance the user's grip when utilizing the product in hot-and-humid weather.

Figure 5:
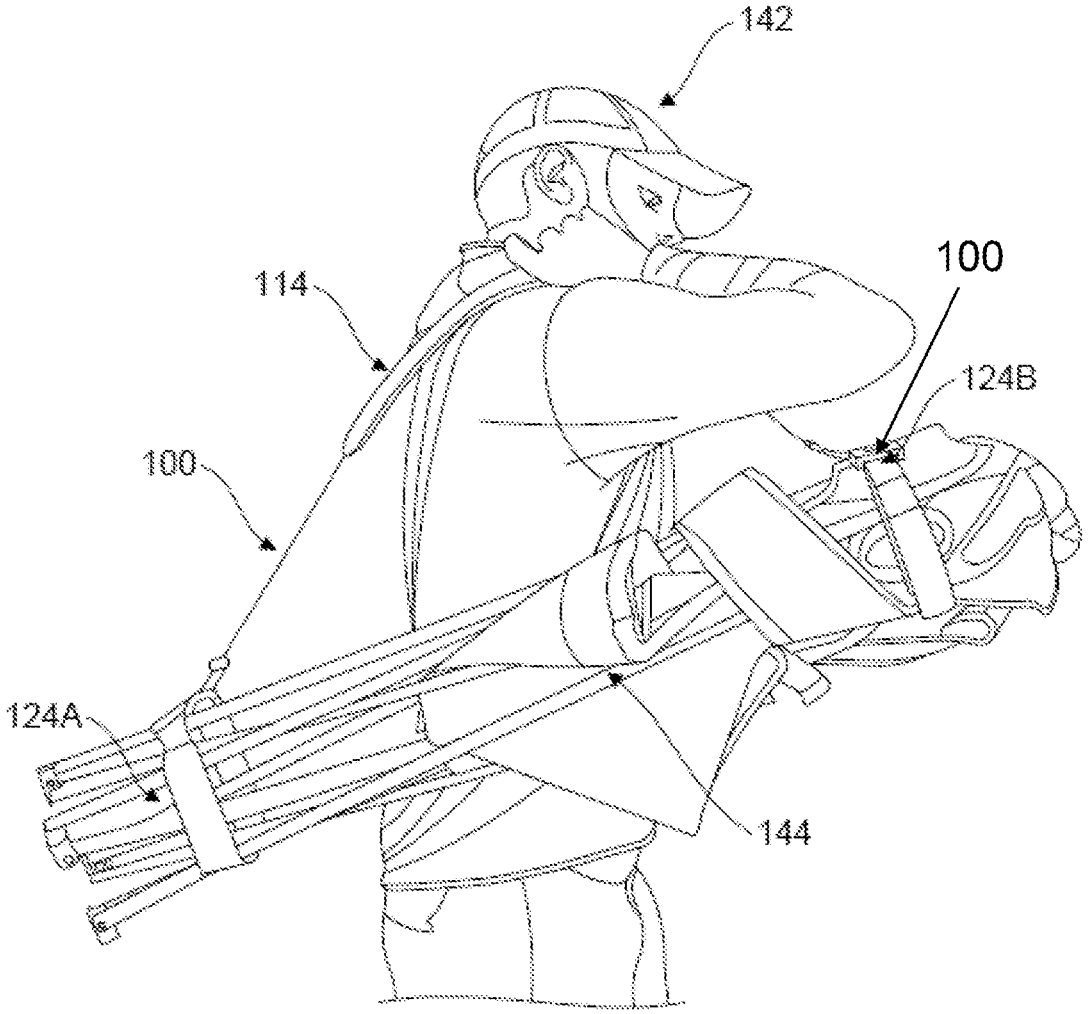
FIG. 5 illustrates a carrying strap system carried by a user in accordance with the present invention.

FIG. 5 illustrates a carrying strap system 100 carried by a user 142 in accordance with the present invention. The carrying strap system is carried by the user simply by placing the carrying strap system on the shoulder of carrying the carrying strap system by hand. In a preferred embodiment of the present invention, the user carries the carrying strap system on their shoulder. To carry an item such as a portable sports chair 144, the user 142 simply uses the buckled strap segments or adjustable first and second loops 124A, 124B to enwrap the portable sports chair 144 at opposite ends. The user grips the base strap 102 to lift the hosted portable sports chair, and then applies the base strap over his or her shoulder. The padded sleeve 114 helps the user to ensure comfort during the transport.

In its use, the carrying strap system 100 allows its user to carry its hosted sports chair (144) and other items while still keeping both hands free, which the user may incorporate to carry other items. Further the carrying strap system is quick and easy to use, and offers several functional features, unlike the standard storage bags that come with typical outdoor folding chairs.

Figure 6:
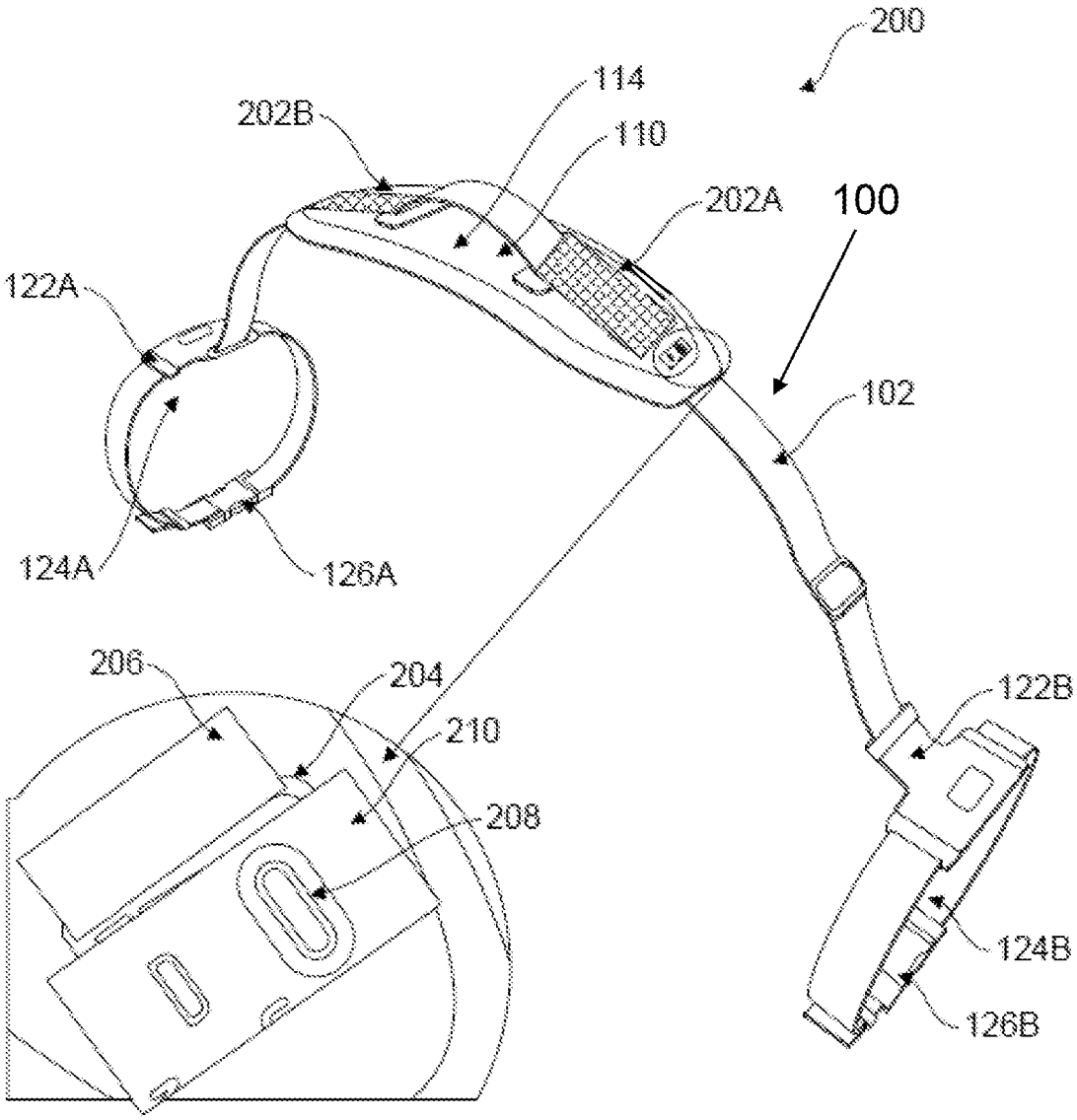
FIG. 6 illustrates a carrying strap system including a charging module in accordance with the present invention.

FIG. 6 illustrates a carrying strap system 100 with a charging module 200 for charging an electronic device while using the carrying strap system. The carrying strap system includes a charging module including in accordance with the present invention. The charging module includes a number of solar panels mounted on an upper surface 110 of the padded sleeve 114 for collecting sunrays. In one exemplary embodiment of the present invention, the upper surface of the padded sleeve hosts two small and flexible solar panels 202A, 202B positioned at equal distance from the center-point 108 on the upper surface 110 of the padded sleeve, at opposite ends of the handle of base strap segment 118.

The padded sleeve 114 further includes an interior pocket 204 for accommodating a transformer 212 and electronic battery 206 for storing charge used for charging the electronic devices. The solar panels 202A, 202B are further connected to the transformer 212 and the electronic battery is placed within the pocket of the padded sleeve. In one exemplary embodiment of the present invention, the transformer and the electronic battery are connected through a wired connection to the solar panels).

The electronic battery 206 is electrically connected with the transformer 212, so that the voltage of the electronic battery is converted into the voltage required through the transformer.

The outside of the transformer 212 is fixedly connected with the inner wall of the pocket 204, the transformer is electrically connected with the electronic battery 206, and the transformer is electrically connected with the storage battery, so that the voltage of the storage battery is converted into the voltage required through the transformer.

Further, the electronic battery 206 is connected through a wired connection to a user interface or charging port 208 mounted on an exterior surface or top surface 210 of the pocket 204 of the padded sleeve 114 for accepting a charging cord for charging portable electronic devices. When desired, the user may plug their charging cord into the user interface or charging port 208 to charge a personal electronic device, such as a smartphone, a tablet, a smart-watch and alike.

During transport and upon arrival to the destination, such as a youth sports sideline and alike destinations, the solar panels 202A, 202B collect solar energy and store it within the hosted electronic battery 206. When desired, the user may plug their charging cord into the charging port or charging ports 208 to charge the personal electronic devices, such as smartphone, a tablet, a smart-watch and alike. The outside of the electronic battery is fixedly connected with the inside of the pocket 204, the outer end faces of the two USB charging ports are fixedly connected with the inside of the bottom end of one side of the pocket, the two USB charging ports are electrically connected with the battery, and the two USB charging ports are electrically connected with the battery so that the mobile phone can be charged by inserting the data line into the charging ports 208, such as USB charging ports.

Figure 7:
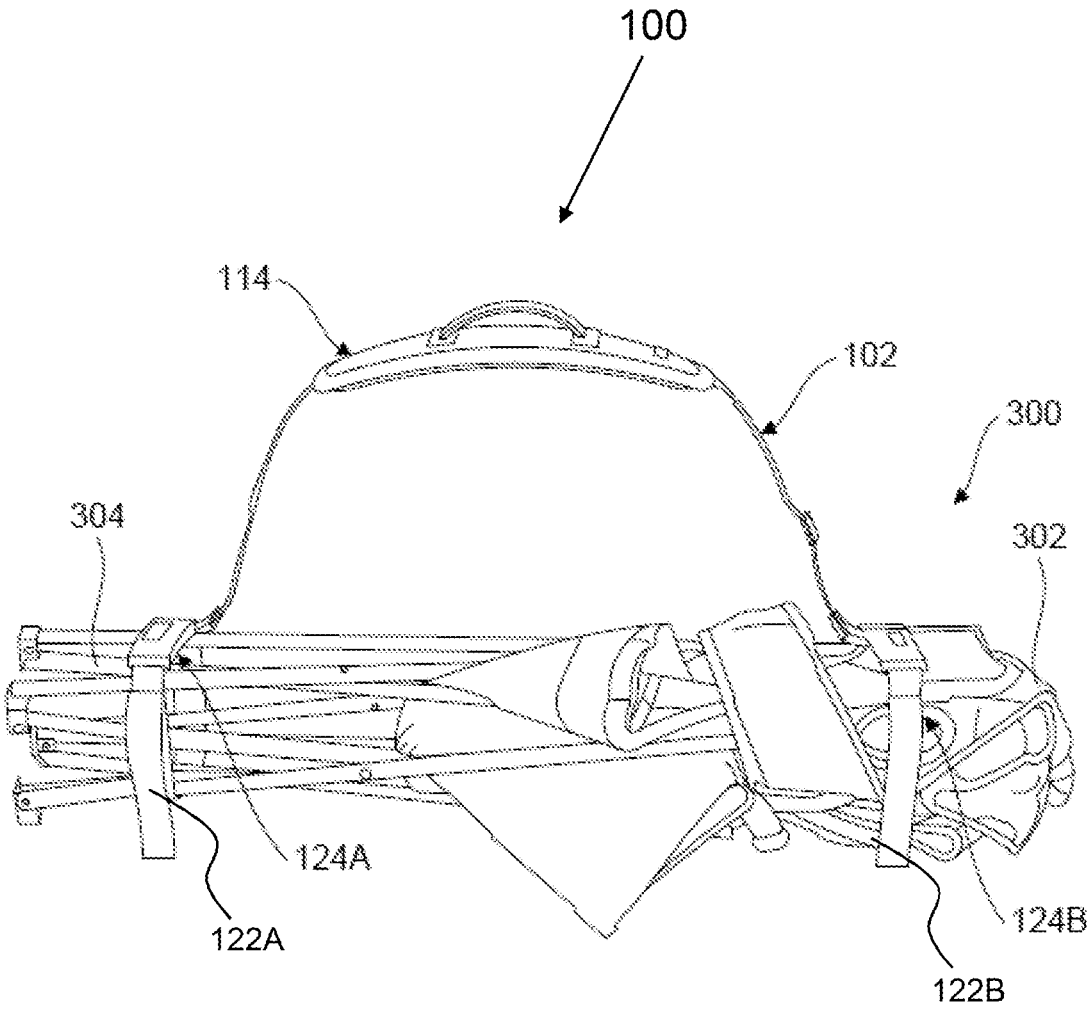
FIG. 7 illustrates a carrying strap system for carrying a sports chair in folded configuration in accordance with the present invention.

FIG. 7 illustrates a carrying strap system 100 for carrying a sport chair 300 in folded configuration in accordance with the present invention. The sports chair includes a first end 302 and a second end 304. The first end includes a seat like structure and the second end of the sports chair includes legs of the sports chair in folded state.

To carry an item such as a portable sports chair 300 and the like, the user simply uses the first strap and second strap 122A, 122B which further form respective adjustable loops 124A, 124B to enwrap the portable sports chair 300 at opposite ends. The user can rest confidently knowing the strap sleeves keep the pair of straps in the right position and easy to use, and the rubber texture on the pair of straps will firmly grip the sports chair.

The first and second strap sleeves 120A, 120B receive a respective first strap 122A and the second strap 122B. The strap sleeves encapsulate the joining point of the base strap 102 with the loop-forming first and second straps 122A, 122B. The strap sleeve increases the durability of the connection point or the joining point as well as prevents the loop-forming straps from twisting and tangling upon themselves. The first and second straps further form respective adjustable first and second loops 124A, 124B to enwrap the first end 302 and the second end 304 of portable sports chair 300 at opposite ends respectively. The user can rest confidently knowing the strap sleeves will keep the straps in the right position and easy to use, and the rubber texture on the straps will firmly grip the sports chair.

Figure 8:
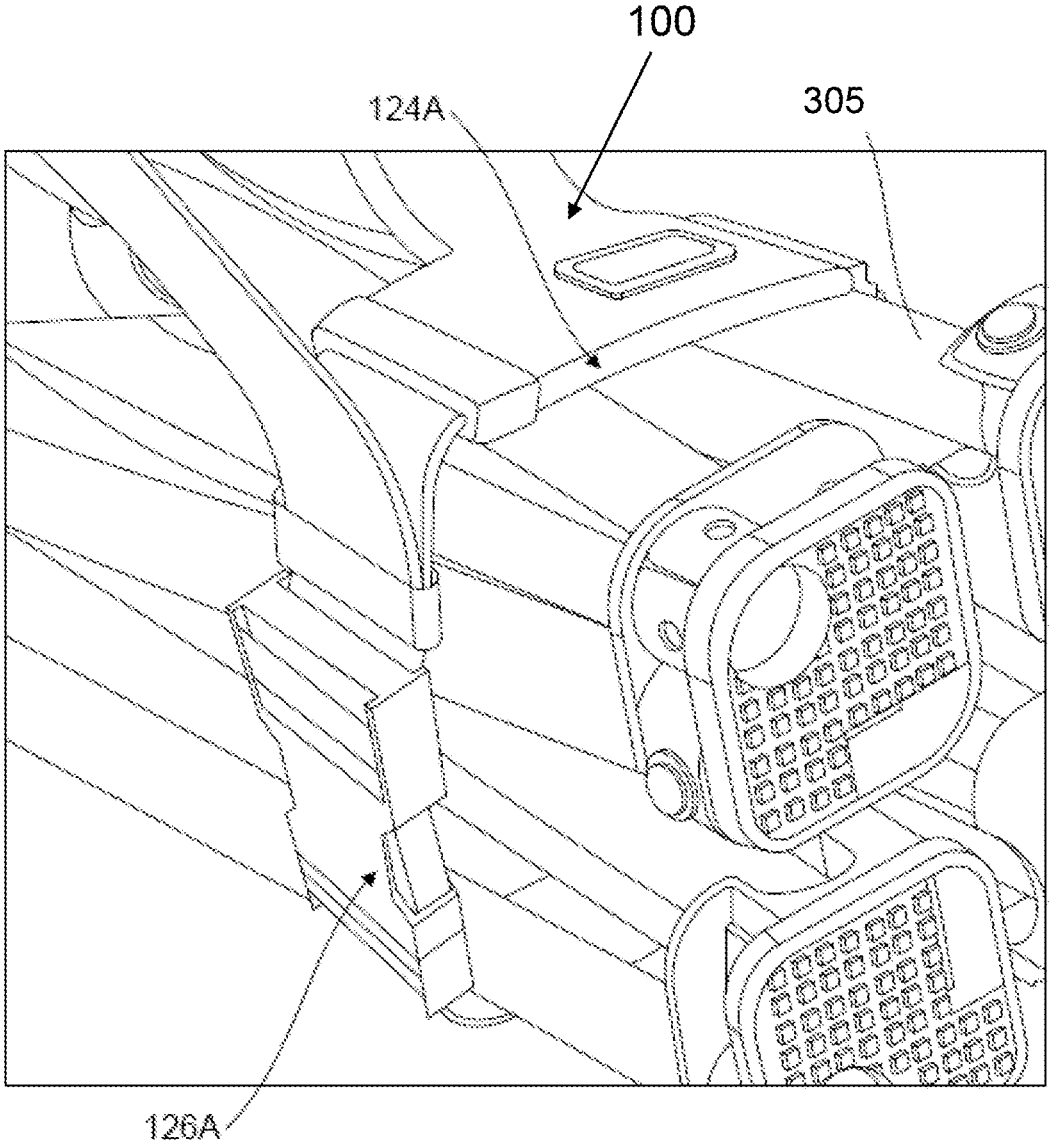
FIG. 8 illustrates a carrying strap system for carrying a sports chair in folded configuration focusing on enwrapping of the adjustable loop around legs of the folded chair in closed configuration in accordance with the present invention.

FIG. 8 illustrates a carrying strap system 100 for carrying a sport chair 300 in folded configuration focusing on enwrapping of the adjustable first loop 124A around legs 305 of the folded chair in closed configuration in accordance with the present invention. The first straps 122A further form an adjustable first loop 124A to enwrap the second end 304 of portable sports chair.

Figure 9:
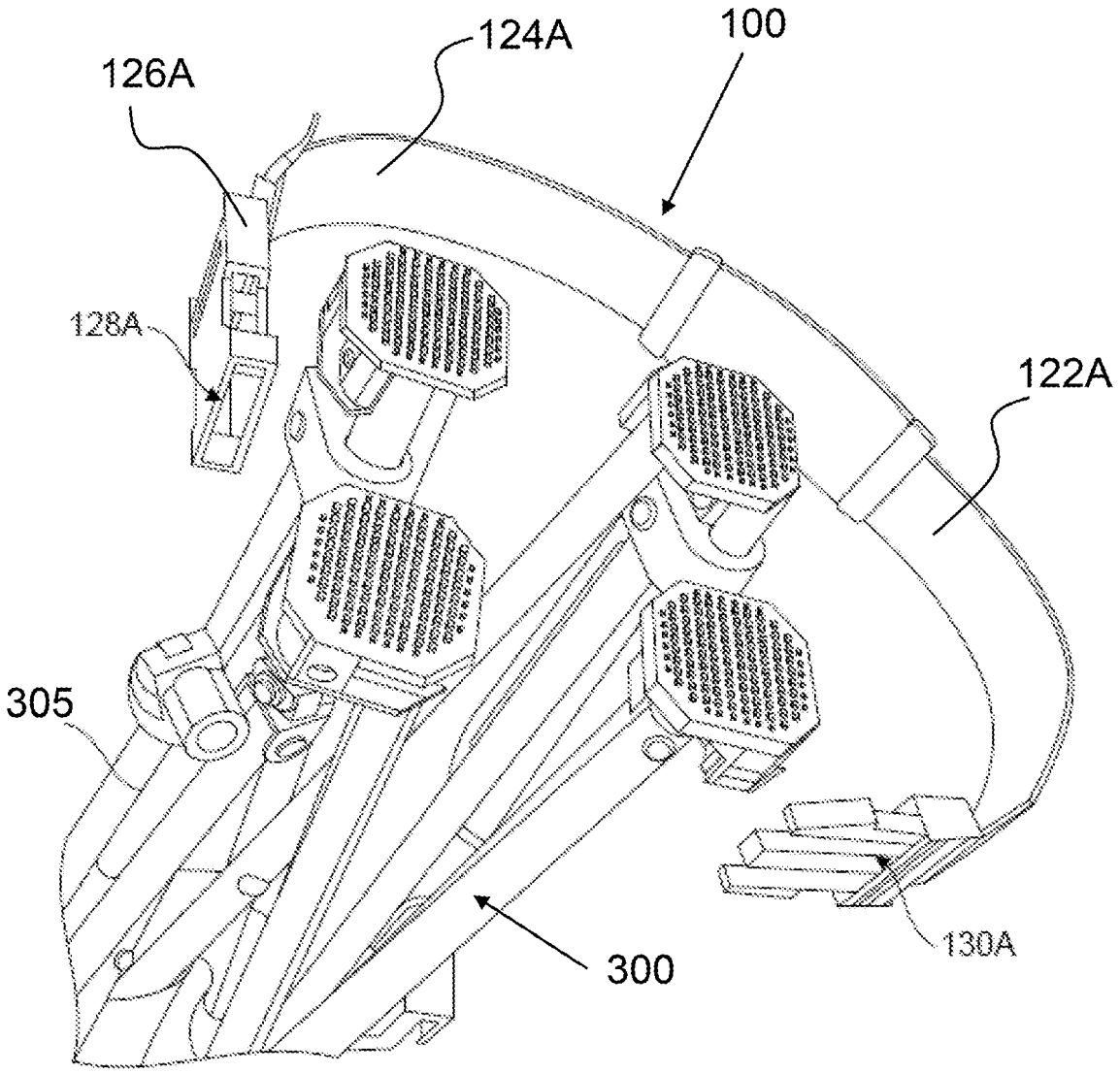
FIG. 9 illustrates a carrying strap system for carrying a sport chair in folded configuration focusing on enwrapping of the adjustable loop around legs of the folded chair in open configuration in accordance with the present invention.

FIG. 9 illustrates a carrying strap system 100 for carrying a sport chair in folded configuration focusing on enwrapping of the first loop 124A around legs 305 of the folded chair 300 in open configuration in accordance with the present invention. The first strap 122A includes a first buckle 126A that includes a first female member 128A secured at one end and a male member 130A secured at another end of the first strap 122A. The female member 128A and a male member 130A are joined together to form an adjustable loop 124A for enwrapping the items within the adjustable loop 124A to transport the portable outdoor furniture.

It is to be understood that the second strap may also have a buckle 126B that includes a second female member secured at one end and a male member secured at another end of the second strap. The female member and the male member of the second strap may also be joined together to form an adjustable loop for enwrapping the items within the adjustable loop 124B to transport the portable outdoor furniture, as shown in FIG. 1. The portable outdoor furniture may be any foldable lounge chairs, foldable deck chairs, foldable canopy chairs, foldable sports chairs and other portable outdoor furniture as well as ice chests, toolboxes, ladders, skis, pipes, lumber, skateboards, conduit, umbrellas and other items.

Figure 10:
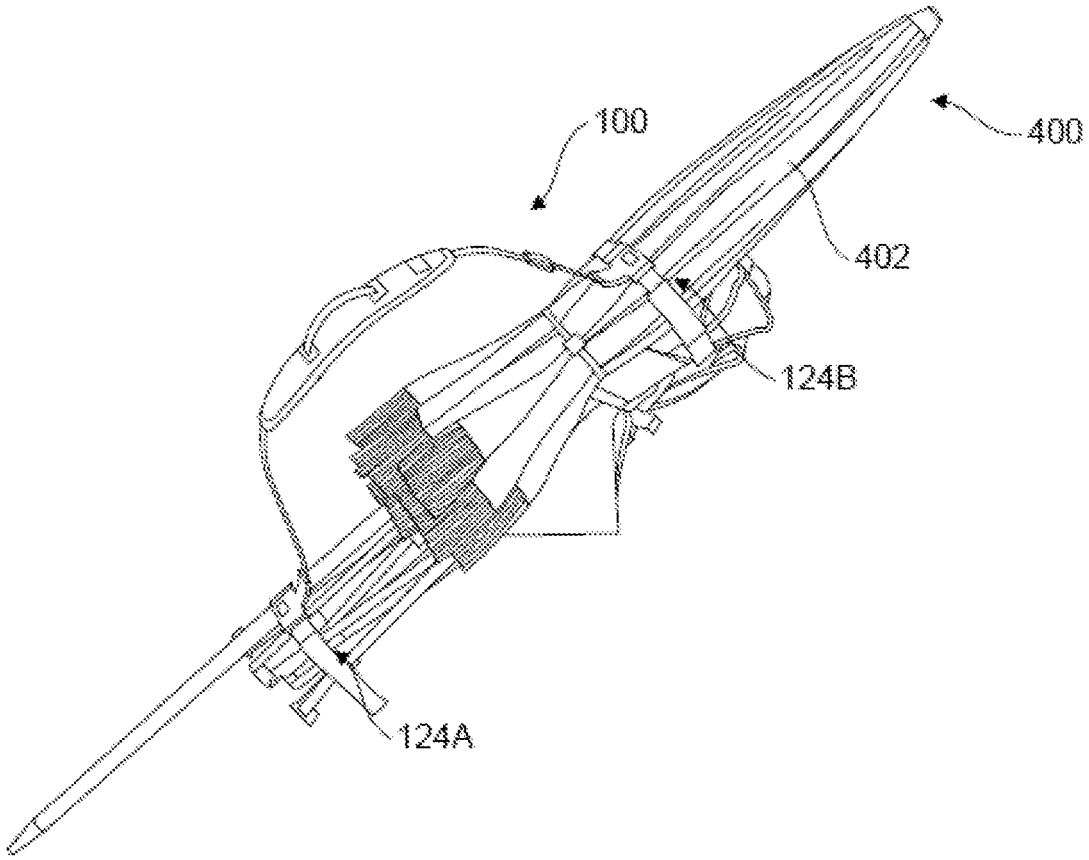
FIG. 10 illustrates a carrying strap system for carrying a sport chair in folded configuration as well as a beach umbrella simultaneously in accordance with the present invention.
Figure 11:
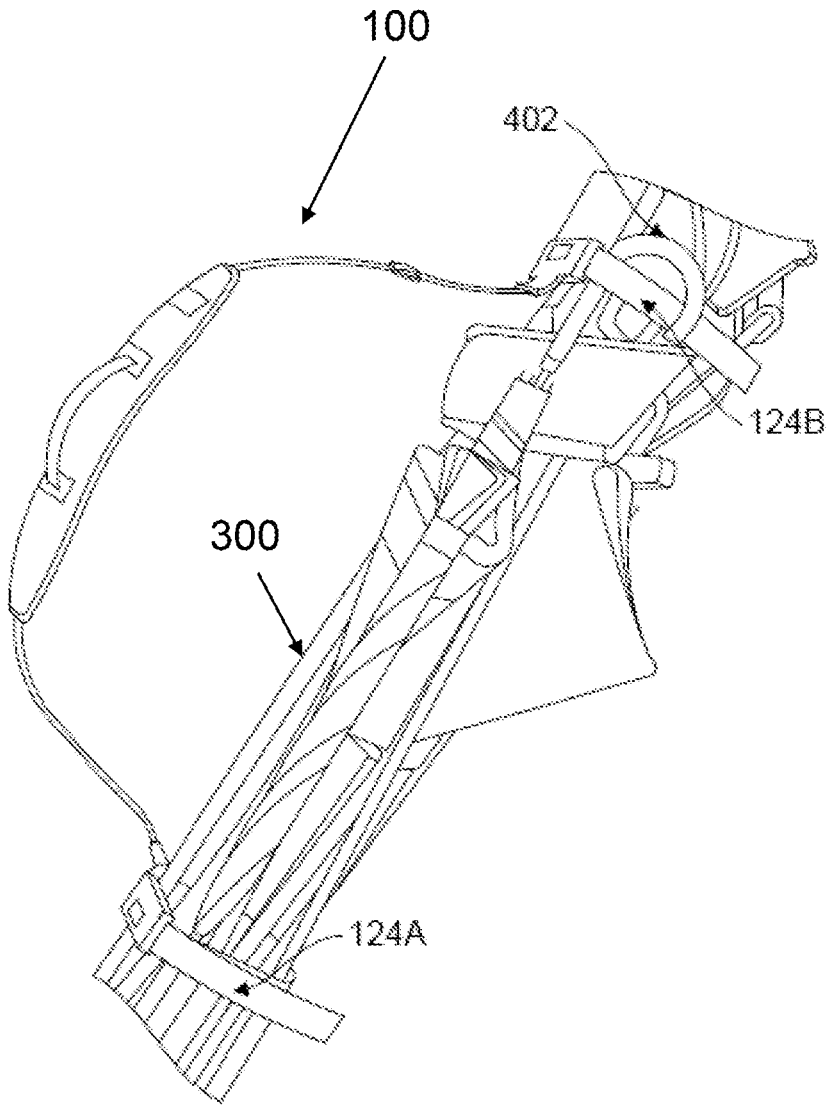
FIG. 11 illustrates a carrying strap system for carrying a sport chair in folded configuration as well as umbrella simultaneously in accordance with the present invention.

With reference now to FIGS. 10 and 11, a carrying strap system 100 is configured for carrying a sport chair 300 in folded configuration as well as umbrella 402 simultaneously in accordance with the present invention. To carry two items simultaneously, such as a foldable outdoor chair and an umbrella, the user can first lay these items directly next to each other. The straps at each length-end of the base strap then enwrap both items simultaneously so that the user may then conveniently carry both items. Other items used with and on the same occasion as the chair, such as but not limited to an umbrella, can also be secured within the first and second loops 124A, 124B, adjustable loops, allowing it to be conveniently transported at the same time and in the same manner. FIG. 11 focuses on the different design of the umbrella 402 with a handle. The portable sports chair 300 and the umbrella 402 are simultaneously enwrapped within the adjustable loops to transport the portable outdoor furniture.

While illustrative implementations of the application have been described in detail herein, it is to be understood that the inventive concepts may be otherwise variously embodied and employed, and that the appended claims are intended to be construed to include such variations, except as limited by the prior art.

Reference throughout this specification to "one implementation" or "an implementation" means that a particular feature, structure, or characteristic described in connection with the implementation is included in at least one implementation of the present invention. Thus, the appearances of the phrases "in one implementation" or "in some implementations" in various places throughout this specification are not necessarily all referring to the same implementation. Furthermore, the particular features, structures, or characteristics may be combined in any suitable manner in one or more implementations.

Systems and methods describing the present invention have been described. It will be understood that the descriptions of some embodiments of the present invention do not limit the various alternative, modified, and equivalent embodiments which may be include within the spirit and scope of the present invention as defined by the appended claims. Furthermore, in the detailed description above, numerous specific details are set forth to provide an understanding of various embodiments of the present invention. However, some embodiments of the present invention may be practiced without these specific details. In other instances, well known methods, procedures, and components have not been described in detail so as not to unnecessarily obscure aspects of the present embodiments.

What is claimed is:

1. A carrying strap system comprising:

a base strap, wherein the base strap includes a first end and a second end opposite to the first end, and a centerpoint;

a padded sleeve with an upper surface and a lower surface, wherein the padded sleeve is positioned at the centerpoint of the base strap, further wherein the padded sleeve includes:

a pair of slits placed at equal distance from the centerpoint, wherein the base strap passes through the lower surface of a first slit to the upper surface of the first slit and received by the upper surface of a second slit to the lower surface of the second slit;

a pocket positioned within the padded sleeve, wherein the pocket includes:

a transformer;

an electronic battery; and a plurality of charging ports connected with the electronic battery by wires to charge one or more electronic items; and a pair of solar panels positioned at equal distance from the centerpoint on the upper surface of the padded sleeve, wherein the pair of solar panels are connected with the wires to the transformer and the electronic battery;

a first strap sleeve, wherein the first strap sleeve receives the base strap from the first end, wherein the first strap sleeve includes a first strap passing through the first strap sleeve, further wherein the first strap is adjustable through a first buckle at ends of the first strap; and a second strap sleeve, wherein the second strap sleeve receives the base strap from the second end, wherein the second strap sleeve includes a second strap passing through the second strap sleeve, further wherein the second strap is adjustable through a second buckle at ends of the second strap.

2. The carrying strap system in accordance with claim 1, wherein:

the first buckle includes a first male member secured at one end and a first female member at another end of the first strap, wherein the first male member and the first female member fasten together to form a first loop; and the second buckle includes a second male member at one end and a second female member at another end of the second strap, wherein the second male member and the second female member fasten together to form a second loop.

3. The carrying strap system in accordance with claim 2, wherein the first loop and the second loop support one or more articles for transporting purposes.

4. The carrying strap system in accordance with claim 1, wherein the carrying strap system carries at least one article including foldable lounge chair, foldable deck chair, foldable canopy chair, foldable sports chair, ice chest, toolbox, ladder, ski, pipe, lumber, skateboard, and umbrellas.

5. The carrying strap system in accordance with claim 1, wherein the padded sleeve includes a hollow interior cavity below the upper surface and above the lower surface of the padded sleeve for accommodating a number of items.

6. The carrying strap system in accordance with claim 5, wherein the hollow interior cavity is capable of being closed with a securing member.

7. The carrying strap system in accordance with claim 6, wherein the securing member is either a zipper, a hook-and-loop material, buttons or ties.

8. The carrying strap system in accordance with claim 5, wherein the number of items is either credit cards, debit cards, smartphones, currencies, and house keys.

9. The carrying strap system in accordance with claim 1, wherein the base strap, first strap and the second strap are made of nylon and polyester in a woven blend, further wherein each of the base strap, first strap and the second strap includes a textured bottom surface for enhancing grip.

10. The carrying strap system in accordance with claim 1, wherein the base strap, first strap and the second strap are made up of either polyester, polyethylene terephthalate (PET), polypropylene, and combination thereof.

11. The carrying strap system in accordance with claim 1, wherein the base strap is forty-eight inches in length by one inch in width (48"×1").

12. The carrying strap system in accordance with claim 1, wherein the lower surface of the padded sleeve features a textured surface for grip enhancement upon a shoulder of a user.

13. The carrying strap system in accordance with claim 12, further wherein the textured surface is formed by nylon fabric with a thin coating of rubber.

14. The carrying strap system in accordance with claim 1, wherein the padded sleeve is eight inches (8") in length by to four-inches (4") in width by three-quarters of an inch (¾") in depth.

15. The carrying strap system in accordance with claim 1, wherein the first buckle and the second buckle are selected from slide-release buckles, cam buckles, lashing clips, snaps, buttons, hook-and-loop material, ties or ratchets.

16. The carrying strap system in accordance with claim 1, wherein the padded sleeve, the first strap sleeve and the second strap sleeve include a logo tab assembly for holding a logo, further wherein the logo tab assembly includes:

a top surface;

a plurality of downward projecting walls projecting downward from the top surface; and a plurality of projecting lip attached at bottom edge of each of the plurality of downward projecting walls; and a plastic indentation for receiving the rectangular tab, wherein the plastic indentation includes one or more projecting protrusions at bottom edge of the plastic indentations for securing the plurality of the projecting lips, thereby the plastic indentation releasably hold the rectangular tab by friction.

17. The carrying strap system in accordance with claim 16, wherein the rectangular tabs are made up of rubber nitrile butadiene rubber (NBR), hydrogenated nitrile (HNBR), carboxylated nitrile (CNBR), acyrlobutadiene styrene (ABS), ethylene propylene diene monomer (EPDM), neoprene, plastic, polypropylene, polyvinyl chloride.

18. The carrying strap system in accordance with claim 15, wherein each of the downward projecting walls are approximately one-eighth of an inch to one-quarter inch (⅛" to ¼").

19. A carrying strap system for carrying an article, wherein the carrying strap system consisting of:

a base strap, wherein the base strap includes a first end and a second end opposite to the first end, and a centerpoint, further wherein the base strap includes an adjustment buckle near at the second end;

a padded sleeve with an upper surface and a lower surface, wherein the padded sleeve is positioned at the centerpoint of the base strap, further wherein the padded sleeve consists:

a pair of slits placed at equal distance from the centerpoint, wherein the base strap passes through the lower surface of a first slit to the upper surface of the first slit and received by the upper surface of a second slit to the lower surface of the second slit; and a hollow interior cavity below the upper surface and above the lower surface of the padded sleeve, wherein the hollow interior cavity is capable of being closed with a securing member;

a first strap sleeve, wherein the first strap sleeve receives the base strap from the first end, wherein the first strap sleeve includes a first strap passing through the first strap sleeve to form a first loop, further wherein the first strap is adjustable through a first buckle at ends of the first strap; and a second strap sleeve, wherein the second strap sleeve receives the base strap from the second end, wherein the second strap sleeve includes a second strap passing through the second strap sleeve to form a second loop, further wherein the second strap is adjustable through a second buckle at ends of the second strap, further wherein the first loop and the second loop support the article to be carried.

20. The carrying strap system in accordance with claim 19, the padded sleeve further includes:

a pair of solar panels positioned at equal distance from the centerpoint on the upper surface of the padded sleeve, and a pocket positioned within the padded sleeve, wherein the pocket includes:

a transformer and an electronic battery connected with the wires to the pair of solar panels; and a plurality of charging ports connected with the electronic battery through wires to charge one or more electronic items.

* * * * *